US011097294B2

(12) United States Patent
Bennani et al.

(10) Patent No.: US 11,097,294 B2
(45) Date of Patent: Aug. 24, 2021

(54) DEVICE FOR ROTATING A FLUID INSIDE A SPRAY NOZZLE, ASSEMBLY COMPRISING SUCH A DEVICE AND COATING DEVICE

(71) Applicant: EXEL INDUSTRIES, Epernay (FR)

(72) Inventors: Tarik Bennani, Paris (FR); Thibault Cognon, Paris (FR); Romain Gaillet, Paris (FR)

(73) Assignee: EXEL INDUSTRIES, Epernay (FR)

( * ) Notice: Subject to any disclaimer, the term of this patent is extended or adjusted under 35 U.S.C. 154(b) by 0 days.

(21) Appl. No.: 15/683,432

(22) Filed: Aug. 22, 2017

(65) Prior Publication Data

US 2018/0071757 A1 Mar. 15, 2018

(30) Foreign Application Priority Data

Sep. 14, 2016 (FR) ..... 1658549

(51) Int. Cl.

| | |
|---|---|
| ***B05B 1/30*** | (2006.01) |
| ***B05B 7/02*** | (2006.01) |
| ***B05B 1/34*** | (2006.01) |
| ***B05B 7/04*** | (2006.01) |
| ***B05B 7/08*** | (2006.01) |
| ***B05B 7/12*** | (2006.01) |
| *B05B 7/06* | (2006.01) |
| *B05B 7/10* | (2006.01) |
| *B05B 7/32* | (2006.01) |

(52) U.S. Cl.

CPC ..... *B05B 7/025* (2013.01); *B05B 1/3046* (2013.01); *B05B 1/3415* (2013.01); *B05B 7/0408* (2013.01); *B05B 7/0823* (2013.01); *B05B 7/1218* (2013.01); *B05B 7/066* (2013.01); *B05B 7/0815* (2013.01); *B05B 7/10* (2013.01); *B05B 7/1272* (2013.01); *B05B 7/32* (2013.01)

(58) Field of Classification Search

CPC ..... B05B 7/025; B05B 1/3046; B05B 1/3415; B05B 7/0408; B05B 7/0823; B05B 7/1218; B05B 7/066

USPC ..... 239/463

See application file for complete search history.

(56) References Cited

U.S. PATENT DOCUMENTS

| | | | | |
|---|---|---|---|---|
| 2,237,842 A | | 4/1941 | Reynolds | |
| 2,908,422 A | | 10/1959 | Braun | |
| 3,123,306 A | | 3/1964 | Bradley | |
| 4,375,275 A | * | 3/1983 | Argazzi | B05B 7/061 239/117 |

(Continued)

FOREIGN PATENT DOCUMENTS

| | | |
|---|---|---|
| BE | 555294 A | 3/1957 |
| CN | 1047815 A | 12/1990 |

(Continued)

OTHER PUBLICATIONS

Search Report issued in connection with French patent application No. 1658549, dated May 16, 2017, 2 pages.

*Primary Examiner* — Chee-Chong Lee
(74) *Attorney, Agent, or Firm* — Duane Morris LLP

(57) ABSTRACT

A device for rotating a fluid inside a spray nozzle includes a body defining at least one helical slot and/or a helical hole for the passage of all or part of the fluid. This device can be secured to a spray nozzle or a needle valve closing the spray nozzle. An application device includes such a device for rotating a fluid inside a spray nozzle.

16 Claims, 5 Drawing Sheets

(56) References Cited

U.S. PATENT DOCUMENTS

Figure 1:
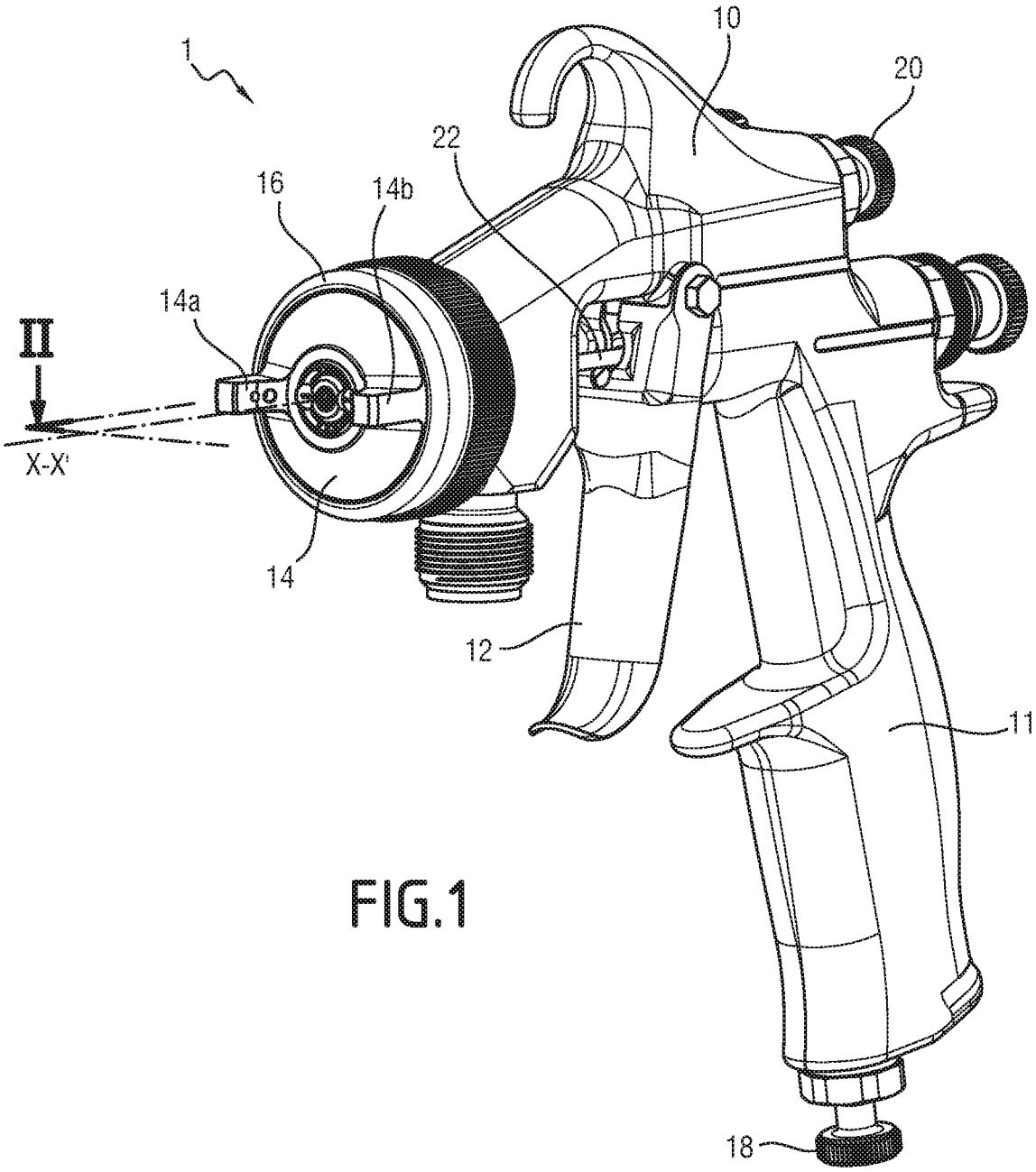

| | | | | |
|---|---|---|---|---|
| 4,560,109 | A * | 12/1985 | Teruyuki | F16J 15/3236 239/526 |
| 4,582,330 | A * | 4/1986 | Lew | F16J 15/025 277/330 |
| 4,801,051 | A * | 1/1989 | Lewis | B05C 5/0237 222/309 |
| 4,852,773 | A * | 8/1989 | Standlick | B05B 1/306 222/504 |
| 4,953,756 | A * | 9/1990 | Breault | B05C 5/02 222/309 |
| 5,277,342 | A * | 1/1994 | Dickau | B05B 1/3066 222/387 |
| 6,402,403 | B1 | 6/2002 | Speakman | |
| 6,460,787 | B1 * | 10/2002 | Hartle | B05B 12/0026 239/691 |
| 2001/0004692 | A1 | 6/2001 | Kidooka et al. | |
| 2013/0068856 | A1 | 3/2013 | Myers et al. | |
| 2013/0288195 | A1 | 10/2013 | Mueller | |

FOREIGN PATENT DOCUMENTS

| | | | |
|---|---|---|---|
| CN | 102205289 | | 3/2013 |
| EP | 0450935 | A2 | 10/1991 |
| EP | 0476705 | A2 | 3/1992 |
| EP | 1016463 | A2 | 7/2000 |
| EP | 1391246 | A2 | 2/2004 |
| EP | 2383043 | A2 | 11/2011 |
| FR | 1317768 | A | 5/1963 |
| JP | S53-145215 | U | 11/1978 |
| JP | 2001169997 | A | 6/2001 |
| JP | 2011156468 | A | 8/2011 |
| JP | 2015505715 | A | 2/2015 |
| KR | 20100088473 | A | 8/2010 |
| RU | 82142 | | 4/2009 |
| RU | 119265 | | 8/2012 |
| RU | 2574755 | | 2/2016 |
| WO | 2013071398 | A1 | 5/2013 |

* cited by examiner

DEVICE FOR ROTATING A FLUID INSIDE A SPRAY NOZZLE, ASSEMBLY COMPRISING SUCH A DEVICE AND COATING DEVICE

The present invention relates to a device for rotating a fluid inside a spray nozzle. In particular, the invention applies to the spray nozzle of a spray gun for a coating product, whether manual or automatic.

In a known manner, a spray gun comprises a spray head with a head ring and the spray nozzle, which is arranged coaxially inside the head. The nozzle comprises a liquid passage channel configured to be closed off selectively by a needle valve translatable inside the nozzle. The movement of the needle valve regulates the opening of the coating product passage. Depending on the position of the needle valve, the coating product will be expelled from the spray nozzle with a higher or lower flow rate.

The spray head arranged around the spray nozzle comprises two ears each traversed by a compressed air discharge conduit. Each conduit is configured so that the air is expelled radially toward the coating product spray. The latter is then atomized into fine droplets under the impact of high-pressure jets of air. The size of the droplets is even more fine when the compressed air pressure is high. However, an excessively high compressed air pressure leads to the formation of a mist that decreases the transfer rate of the gun, i.e., the ratio between the quantity of product sprayed by the gun and the quantity of product actually deposited on the part to be coated (overspray).

EP-A-1,391,246 discloses a solution for improving the atomization without increasing the compressed air pressure. This solution consists of housing, inside the central conduit of the nozzle, a device to fragment the liquid flow. This device comprises a case, a seat for positioning the case and a spacer part. The case and the seat define passage holes for the product, arranged to impose abrupt changes in direction on the flow of coating product, which disrupts the flow. The flow is thus destabilized upstream from the outlet orifice and the product is ejected from the nozzle in a turbulent form, i.e., partly defragmented. This makes it possible to atomize the product jet effectively, but without increasing the pressure of the air jets. The drawbacks of this device are the inability to widen the spray, its manufacturing cost (three separate parts) and its assembly difficulties. Furthermore, this device is difficult to clean.

The invention more particularly aims to resolve these drawbacks by proposing a rotating device that is easier to manufacture, less expensive, and easier to assemble inside the spray nozzle.

To that end, the invention relates to a device for rotating a fluid inside a spray nozzle, the device comprising a body defining at least one helical slot and/or a helical hole for the passage of all or part of the fluid.

Owing to the invention, the slot(s) and/or the hole(s) of the device give the liquid circulating inside the spray nozzle a helical direction around a spray axis. The rotation upstream from the outlet orifice of the spray nozzle results in a widening of the spray. Furthermore, the flow is destabilized, or even turbulent, which makes it easier to atomize. Thus, the device makes it possible to obtain a distribution of finer drops, without increasing the pressure and/or the flow rate of the atomization air jets. In other words, the device makes it possible to obtain a gun with an atomization fineness identical to that of the guns of the prior art, but with a lower compressed air consumption, and therefore better performance.

According to advantageous, but optional aspects of the invention, such a device may comprise one or more of the following features, considered in any technically allowable combination:

- An enclosure surface of the body has a circular or elliptical section.
- The enclosure surface of the body is at least partially cylindrical and/or frustoconical.
- The enclosure surface of the body comprises a cylindrical upstream part and a frustoconical downstream part. Owing to this specific shape, the body may be pushed as deeply as possible inside the spray nozzle, in particular as close as possible to the product discharge orifice. In particular, this arrangement is made possible by the shape of the device, which ends in a frustum, since the inner conduit of a spray nozzle traditionally comprises a segment with a frustoconical section before the product discharge segment. This arrangement as close as possible to the discharge orifice makes it possible to prevent the fluid from losing speed, i.e., guarantees that the fluid retains its rotation to the outlet of the spray nozzle.
- The device further comprises a gripping handle, which has a smaller diameter relative to the body.
- The length of the handle is greater than or equal to 5 mm.
- The device defines a central through bore for the passage of a needle valve closing the spray nozzle.
- The device is manufactured by 3D printing.
- The body comprises a cylindrical upstream part and a frustoconical downstream part, whereas each helical slot extends continuously on the surface of the cylindrical upstream part and the surface of the frustoconical downstream part.
- The body comprises a cylindrical upstream part and a frustoconical downstream part, whereas each helical hole extends continuously through the cylindrical part and through the frustoconical downstream part of the body.

The invention also relates to an assembly comprising a device as previously described and a part from among a spray nozzle and a needle valve closing the spray nozzle. The device and said part are secured to one another or form a single piece.

The invention lastly relates to an application device, such as a manual or automatic spray gun, comprising an assembly or a device as previously described.

Advantageously, the device is immobilized inside a liquid passage conduit defined by a spray nozzle.

Advantageously, the conduit defines a housing for receiving the device that has a shape complementary to that of an enclosure surface of the body of the device.

Advantageously, the device comprises a spray nozzle that defines a fluid passage conduit, while the conduit comprises a flared and rounded discharge segment.

Figure 3:
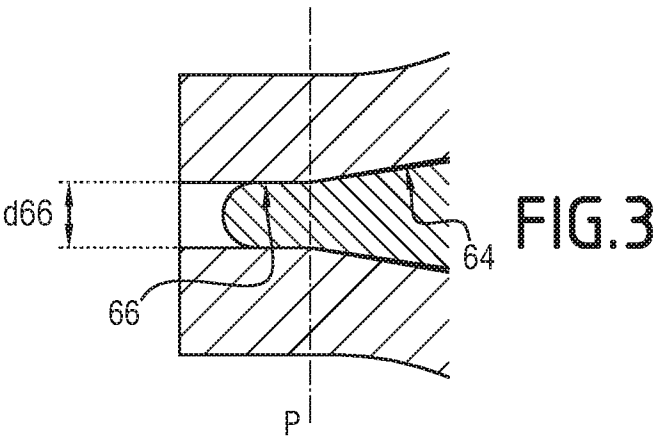
Figure 2:
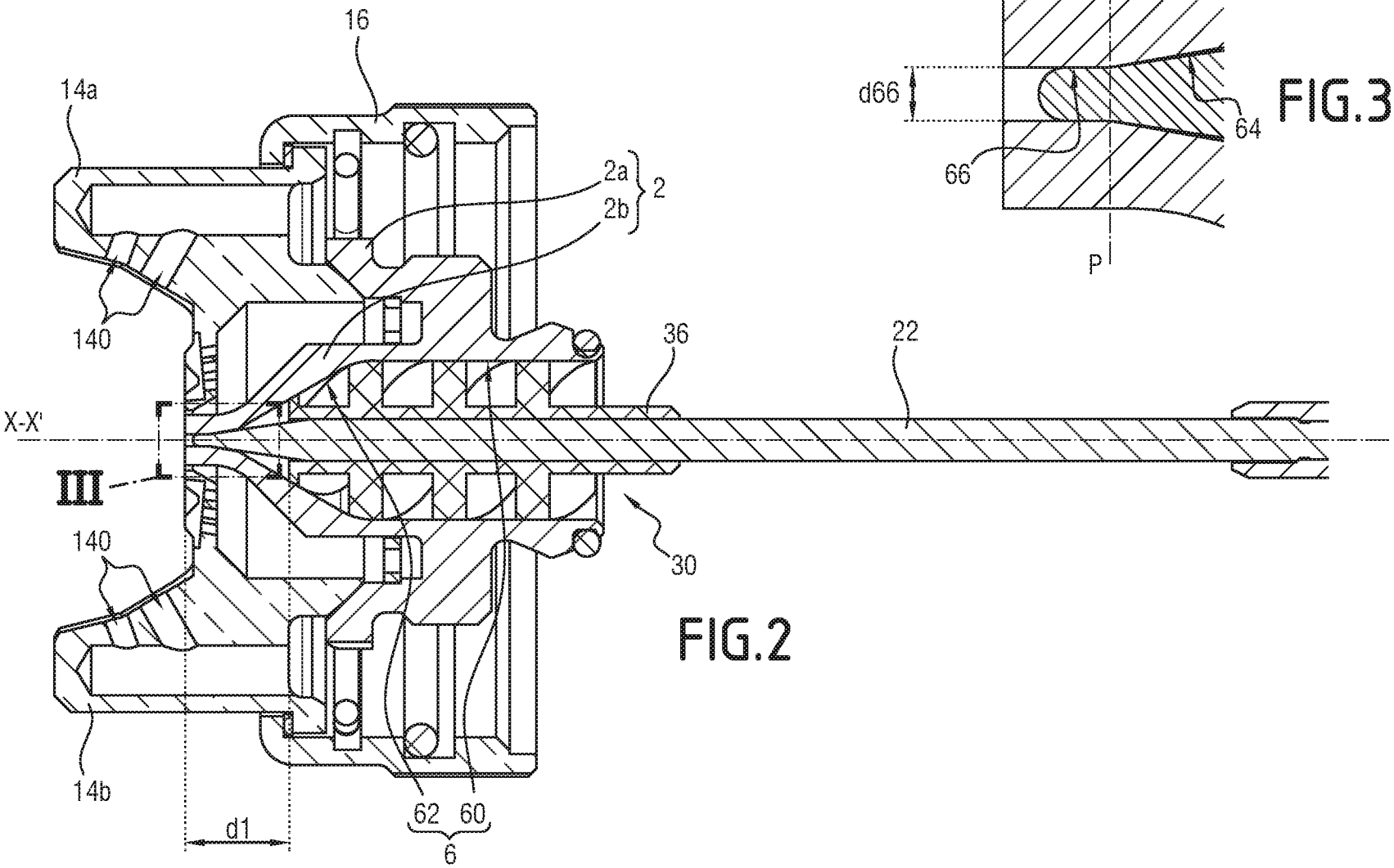
Figure 5:
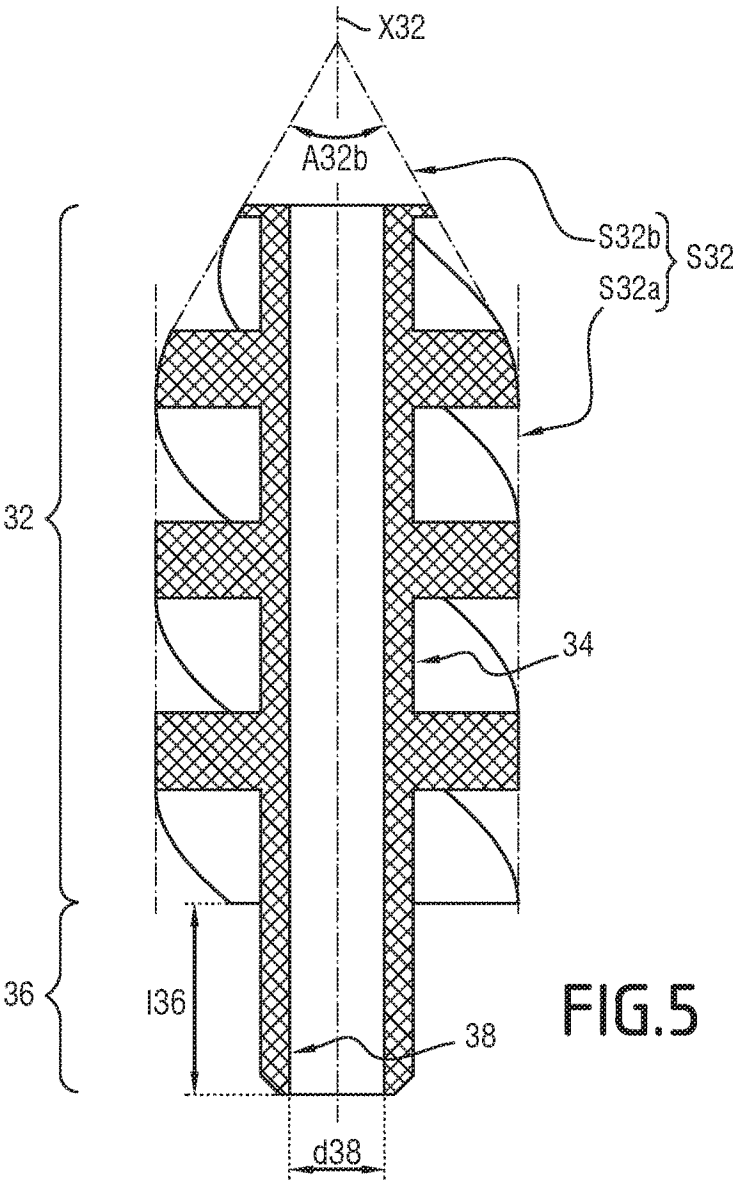
Figure 4:
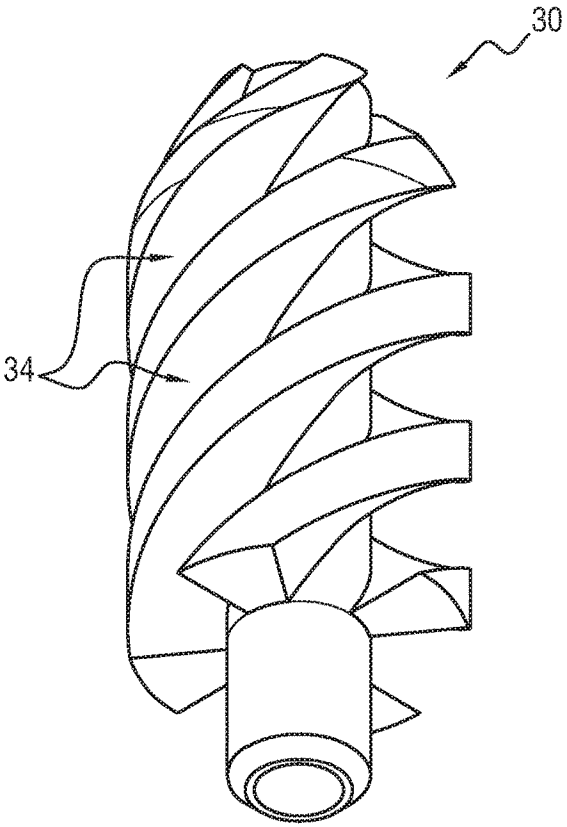
Figure 6:
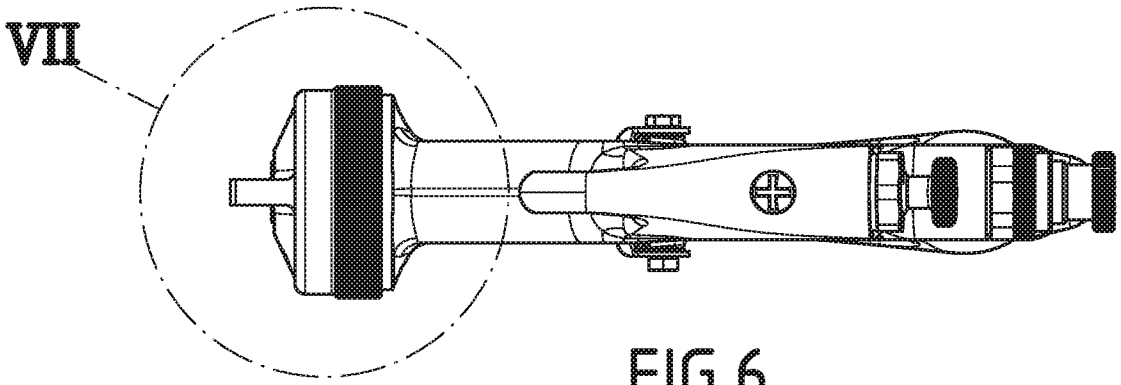
Figure 7:
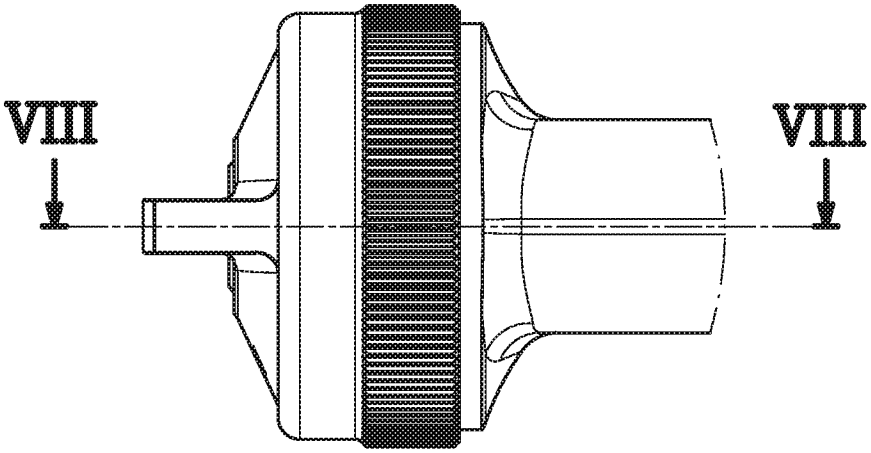
Figure 8:
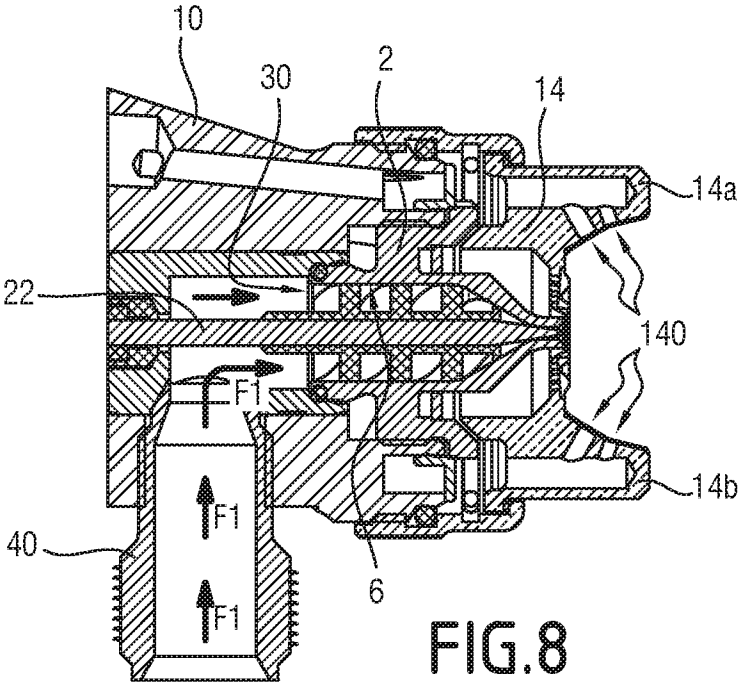
Figure 10:
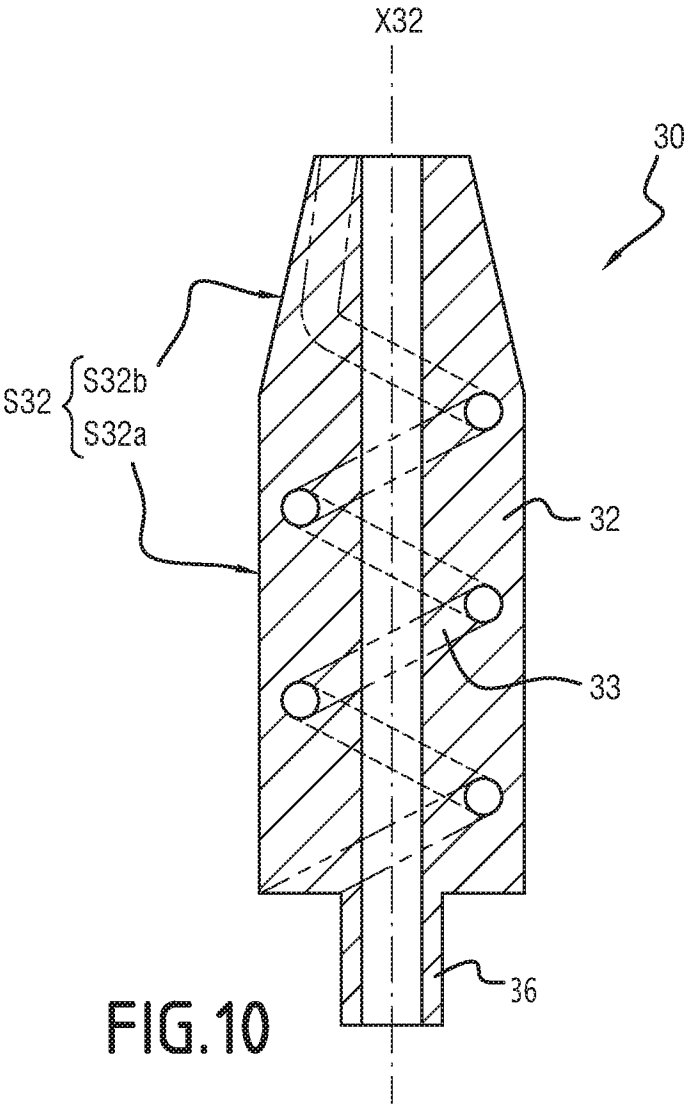
Figure 9:
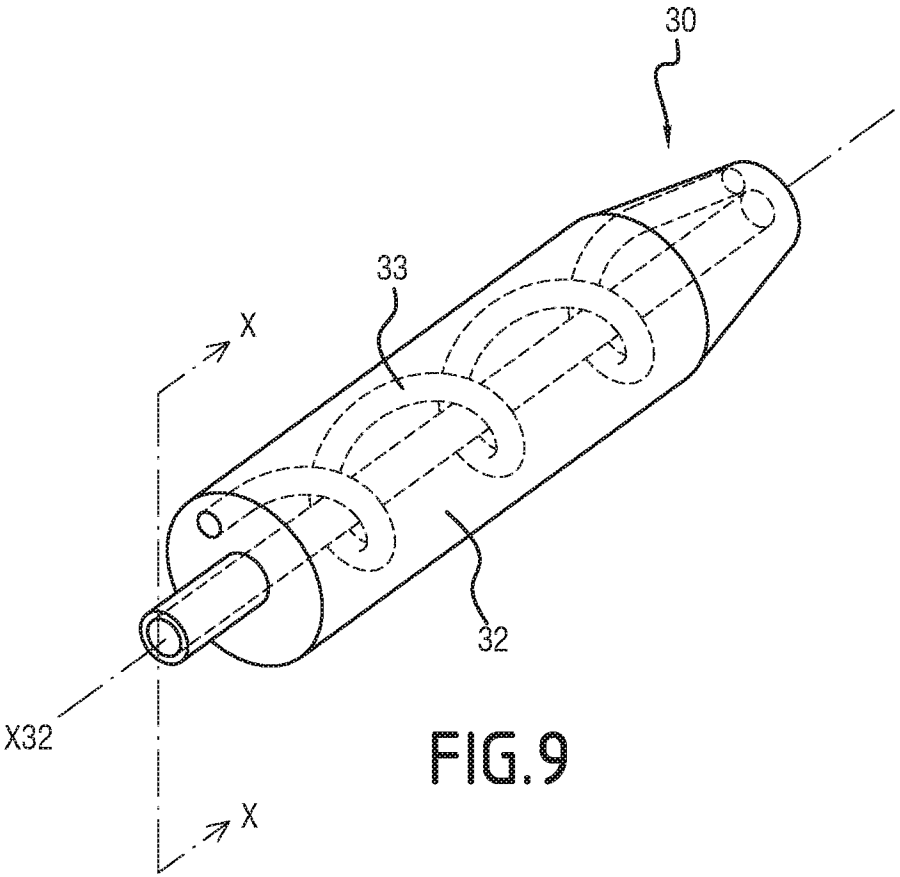

The invention and other advantages thereof will appear more clearly in light of the following description of two embodiments of a rotation device according to its principle, provided solely as an example and done in reference to the appended drawings, in which:

FIG. 1 is a perspective view of a coating product spray gun, comprising a rotation device according to a first embodiment of the invention, FIG. 2 is a partial sectional view in plane II of FIG. 1, FIG. 3 is an enlarged view of box III of FIG. 2, FIG. 4 is a perspective view of the rotation device, FIG. 5 is a longitudinal sectional view of the device according to the invention, FIG. 6 is an elevation view of the gun of FIG. 1, in which the spray head has been pivoted by 90°, FIG. 7 is an enlarged view of circle VII of FIG. 6, FIG. 8 is an (enlarged) sectional view along line VIII-VIII in FIG. 7, FIG. 9 is a perspective view of a rotation device according to a second embodiment of the invention, and FIG. 10 is a sectional view in plane X of FIG. 9.

FIGS. 1 and 6 show a manual gun 1 for spraying a coating product. The coating product can be a liquid comprising one or several components or a powdered material. It may be paint, primer, varnish, etc.

The gun 1 comprises a body 10, a gripping stock 11 and an actuating trigger 12 articulated on the body 10. The gun 1 comprises a spray head 14 and a head ring 16 arranged around the head 14. The head 14 and the head ring 16 are centered on a spray axis X-X'. The spray head 14 can advantageously be pivoted around the axis X-X' to orient the spray in a substantially horizontal plane, like in the configuration of FIGS. 1 to 3, or in a substantially vertical plane, like in the configuration of FIGS. 6 to 8.

As shown in FIG. 2, the head 14 is hollow. It comprises two protuberances 14*a* and 14*b*, more commonly called horns or ears, that are arranged diametrically opposite one another. The horns 14*a* and 14*b* protrude parallel to the axis X-X' relative to the rest of the head 14. They each define two compressed air discharge orifices 140. The orifices 140 are configured to guide air jets toward the spraying axis X-X'. More specifically, the air jets from the orifices 140 have a substantially radial and centripetal direction relative to the spray axis X-X' of the gun. The adjective "substantially" means here that there is a deviation of several degrees between a direction strictly radial to the axis X-X' and the direction of the air jets. The gun shown in FIG. 1 is therefore a gun of the pneumatic type, using air jets to form the spray.

A spray nozzle 2 is arranged coaxially inside the head 14. The spray nozzle 2 is a standard spray gun spray nozzle. It is a part having a geometry of revolution around the axis X-X'. In the example, the spray nozzle 2 comprises two coaxial parts 2*a* and 2*b*, the part 2*a* being arranged inside the part 2*b*. The spray nozzle 2 defines a passage conduit 6 for the product. The conduit 6 is situated inside the part 2*a*. The spray nozzle 2 is a spray nozzle of the "flat jet" type, i.e., it is a spray nozzle whose cavity assumes the form of a stretched ellipse. However, alternatively, the spray nozzle 2 may be a spray nozzle of the "round jet" type, i.e., a spray nozzle whose cavity assumes the form of a disc or ring.

The conduit 6 is configured to be selectively closed off by a needle valve 22 axially translatable inside the spray nozzle 2. The movement of the needle valve 22 is controlled by the trigger 12. A return spring (not shown) makes it possible to return the needle valve to the closed position when the operator releases the trigger 12.

An upstream direction is defined here as a direction oriented in the direction opposite the flow of liquid, and a downstream direction as a direction oriented in the direction of the flow. In the configuration of FIG. 2, the upstream direction is oriented to the right, while the downstream direction is oriented to the left.

As shown in FIGS. 2 and 3, the conduit 6 comprises, from upstream to downstream, a first cylindrical segment 60, a second frustoconical segment 62, the passage section of which decreases from upstream to downstream, a third segment 64, also frustoconical and having a section that decreases from upstream to downstream, and a discharge channel 66, with a constant passage section.

In the present document, the "caliber" of a spray nozzle corresponds to the diameter of the last passage section of the fluid before discharge, i.e., in the example, the diameter d66 of the discharge channel 66. In practice, the caliber of a spray nozzle varies between 0.4 mm (spray nozzle with caliber 4) and 2.7 mm (spray nozzle with caliber 27).

A plane P is defined as the sealing plane of the needle valve 22 inside the spray nozzle 2. The plane P is perpendicular to the spray axis X-X'. As shown in FIG. 3, the plane P is arranged at the interface between the segment 64 and the channel 66. The spray nozzle 2 according to the invention has the advantage that the position of the sealing plane P along the axis X-X' is standard, i.e., the spray nozzle 2 is compatible with a commercially available needle valve, like the needle valve 22. This makes it possible to guarantee the flow rate of the spray nozzle 2 and to limit the presence of dead spaces, which may retain product and cause drops to form after the spray nozzle 2 is closed.

During operation, the jets of air from the horns 14*a* and 14*b* of the head 14 strike the jet of product discharged through the spray nozzle 2. Advantageously, the pushbuttons 18 and 20, shown in FIG. 1, are provided to interrupt the spraying of product and the use of compressed air, respectively.

A removable device 30 is immobilized inside the conduit 6. The device 30 is designed for standard gun spray nozzles. It is a device for rotating fluid inside the conduit 6. It comprises a body 32, the enclosure surface S32 of which has a circular section. The enclosure surface is defined as a surface enclosing the body 32. One can then imagine the surface S32 as the surface of the body 32 when the latter is enclosed in a film with a zero thickness. The enclosure surface S32 is centered on an axis X32 that is combined with the axis X-X' when the device 30 is in place inside the conduit 6.

In the example, the device 30 is a machined metal part. However, alternatively, the device 30 can be made from plastic and can be made using other means, for example molding or a 3D printer.

In the example, the enclosure surface S32 of the body comprises a cylindrical part S32*a* and a frustoconical part S32*b* arranged downstream from the cylindrical part S32*a*. The diameter of the frustoconical part S32*b* of the surface S32 decreases in the downstream direction. The convergence angle S32*b* of the frustoconical part S32*b* is comprised between 10 and 350°, in particular between 10° and 180° or between 180° and 350°, preferably from 10 to 80°, here equal to 60°.

The conduit 6 defines a housing for receiving the device 30 that has a shape complementary to that of the body 32. In other words, the diameter of the housing 60 is identical in all points to the diameter of the enclosure surface S32. This housing is formed by the segments 60 and 62 of the conduit 6. Thus, the diameter of the cylindrical part S32*a* of the enclosure surface of the body 32 is substantially identical to the diameter of the cylindrical segment 60 of the conduit 6 and the convergence angle of the frustoconical part S32*b* of the surface S32 is identical to that of the segment 62.

In practice, the device 30 is slide inside the conduit 6. In the example, it is long enough to remain immobile in translation during the manipulation of the gun 1. In an alternative that is not shown, an additional abutment device, such as a tubular sleeve mounted gripped or glued to the inside of the conduit 6, can be incorporated into the spray nozzle 2 to keep the device 30 immobile in translation.

Furthermore, the device 30 may also be forcibly mounted inside the conduit 6.

The body 32 includes at least one helical slot 34, preferably four helical slots 34, each having a pitch comprised between 1 mm and 50 mm, in the example equal to 20 mm. In the example, the pitch of each slot 34 is constant. However, in an alternative that is not shown, this pitch may be variable.

Each slot 34 extends over the outer surface of the body 32 that defines a passage conduit for the product. More specifically, during operation, the product circulates in the slots 34, between the body 32 and the wall making up the conduit 6. The slots 34 give the fluid a helical direction around the spray axis X-X'. The speed of the fluid leaving the device 30 therefore has an axial component and a radial component relative to the spray axis X-X'.

As shown in FIGS. 4 and 5, the body 32 comprises a cylindrical upstream part and a frustoconical downstream part, and each helical slot 34 extends continuously on the surface of the cylindrical upstream part and the surface of the frustoconical downstream part.

Advantageously, the depth P34 of each slot 34 is comprised between 1% and 49% of the maximum diameter of the surface S32, in particular equal to 25% of this diameter.

Thus, unlike the device of EP-A-1,391,246, the device 30 is in a single piece, which facilitates assembly.

The ratio between the radial speed component and the axial speed component at the outlet of the device 30 depends on the pitch of the slot(s) 34. In particular, the rotational component of the speed vector of the fluid at the outlet of the device 30 is even greater when the pitch is small. Preferably, the pitch is chosen to be smaller when fluid is viscous. In the example, the rotational component of the speed vector of the fluid at the outlet of the device 30 is about three times greater than the axial component.

However, the rotational effect is lessened at the spray nozzle outlet for spray nozzles 2 with a small caliber, in particular for spray nozzles with a caliber smaller than 0.9 mm, since the fluid undergoes a strong axial acceleration in the channel 66 due to the reduction in the passage section. Thus, the axial component of the fluid at the spray nozzle outlet prevails over the radial component. Conversely, for spray nozzles with a large caliber, i.e., for spray nozzles having a caliber at least equal to 0.9 mm, the fluid undergoes less axial acceleration in the discharge channel 66 and is discharged with a substantial rotational component. Consequently, the device 30 is rather intended to be mounted inside nozzles with a caliber of at least 0.9 mm.

Advantageously, the device 30 is pushed as deeply as possible inside the conduit 6, i.e., as close as possible to the outlet orifice of the spray nozzle 2. In the example, the distance d1 between the downstream end of the device 30 and the outlet orifice of the spray nozzle 2 is less than 10 mm, in particular equal to 6 mm. This guarantees that the fluid retains its rotation to the outlet of the spray nozzle 2.

Advantageously, the device 30 further comprises a gripping handle 36, which has a smaller diameter relative to the body 32. The gripping handle 36 extends axially in the upstream direction relative to the body 32. It advantageously allows the manual removal of the device 30 from the spray nozzle 2 for cleaning and/or replacement. The handle 36 advantageously extends over a length 136 at least equal to 5 mm. This minimum length allows the device 30 to be pushed as deeply as possible inside the conduit 6, i.e., as close as possible to the outlet orifice of the spray nozzle 2.

In the example, the device 30 defines a through bore 38 for the passage of the needle valve 22 closing the spray nozzle 2. The bore 38 extends axially through the handle 36 and the body 32. The diameter d38 of the bore 38 is substantially equal to the diameter of the needle valve 22, such that the product does not pass inside the body 32. However, in an alternative that is not shown, the diameter d38 of the bore 38 can be chosen to be greater than the diameter of the needle valve 22, such that the product can pass inside the body 32. This has the advantage that the obtained spray is easier to spray and requires less energy (for example, pneumatic) to be sprayed.

As shown in FIG. 8, the gun 1 comprises a coupling 40 for supplying coating product. This coupling 40 is oriented perpendicularly relative to the spray axis X-X' and in particular extends downward from the body 10 of the gun 1. It is intended to be connected to a product supply hose (not shown). The conveyance of the coating product from the coupling 40 to the outlet orifice of the spray nozzle 2 is shown by arrows F1 in FIG. 8.

Independently of the above, FIGS. 9 and 10 show a second embodiment of the invention. This second embodiment relates to a device 30 for rotating a fluid inside a spray nozzle 2, this device comprising a body 32 defining at least one helical hole 33 for the passage of all or part of the fluid. Thus, compared with the first embodiment, at least one slot 34 is replaced by a helical conduit, i.e., a hole 33 traveling through the body of the device 30 in a substantially helical direction. Such a device may for example be manufactured by 3D printing. In an alternative that is not shown, the body 32 defines several helical holes 33 for the passage of all or part of the fluid.

According to advantageous, but optional aspects, this device 30 may comprise one or more of the following features, considered in any technically allowable combination:

- The body 32 comprises a cylindrical upstream part and a frustoconical downstream part, whereas each helical hole 33 extends continuously through the cylindrical part and through the frustoconical downstream part of the body.
- An enclosure surface S32 of the body 32 has a circular or elliptical section.
- The enclosure surface S32 of the body 32 is at least partially cylindrical (see surface S32*a*) and/or frustoconical (see surface S32*b*).
- The enclosure surface S32 of the body comprises a cylindrical upstream part S32*a* and a frustoconical downstream part S32*b*.
- The device further comprises a gripping handle 36, which has a smaller diameter relative to the body 32.
- The length of the handle 36 is greater than or equal to 5 mm.
- The device defines a central through bore 38 for the passage of a needle valve 22 closing the spray nozzle 2.
- The body 32 defines at least one helical slot for the passage of all or part of the fluid.
- The device is manufactured by 3D printing.

As an alternative that is not shown, the needle valve 22 and the device 30 are secured to one another. In particular, the device 30 can be mounted gripped around the needle valve 22 or crimped or glued to the needle valve 22. The device 30 and the needle valve 22 can also be in a single piece.

According to another alternative that is not shown, the spray nozzle 2 and the device 30 are inseparably connected. In particular, the spray nozzle 2 and the device 30 can be two parts secured to one another or a single and same part, for example manufactured by 3D printing. The slot(s) 34 of the device 30 are cleaned by injecting solvent instead of the coating product.

According to another alternative that is not shown, the device 30 is mounted inside an automatic gun, which operates with no manual action by an operator and which is controlled remotely.

According to another alternative that is not shown, the section and/or the width of the slots 34 can be different from one slot to another. The section and/or the width of each slot can also vary depending on its length. The section of each slot 34 can be rectangular, triangular, elliptical, polygonal, or in a shape inspired by these solutions (3D printing). The area of the section can also be variable. It is comprised between 0.2 $mm^2$ to 8 $mm^2$. According to another alternative that is not shown, the conduit 6 of the spray nozzle 2 comprises an ejection segment is flared and rounded. This makes it possible to further widen the spray leaving the spray nozzle by Coanda effect. This solution for widening the jet is particularly suitable for spray nozzles with a small caliber (smaller than 0.9 mm), for which the rotational effect imparted by the device 30 is smaller. In practice, this type of spray nozzle procures a synergistic effect with the device 30 when the caliber is comprised between 0.7 and 1.2 mm.

According to another alternative that is not shown, two rotation devices according to the invention, i.e., comparable or identical to the rotation device 30, are arranged in series behind one another inside the conduit 6. Advantageously, the two devices have inverse threads: each slot of a first device has a right thread, while each slot of it the second device has a left thread, or vice versa. This makes it possible to further destabilize the fluid flow. The two devices can be made in a single piece.

According to another alternative that is not shown, the application device comprises two separate conduits for supplying coating product. This may be the same product or two different products to be mixed. Each supply conduit communicates with a corresponding slot 34 of the device 30, which then includes at least two slots. The products circulating in the two separate conduits are mixed downstream from the device 30. Part of the fluid circulating inside the spray nozzle then therefore passes through a slot. More generally, each slot of the device communicates with a separate conduit supplying coating product. The number of product supply conduits may therefore be greater than 2.

The features of the alternatives and embodiment considered above may be combined with one another to create new embodiments of the invention.

The invention claimed is:

1. A spray gun for a liquid coating product, comprising:

a spray nozzle disposed around a spray axis of the spray gun, the spray nozzle defining a liquid passage conduit for the liquid coating product to be discharged, the liquid coating product circulating through the liquid passage conduit;

a needle valve, translatable inside the spray nozzle for selectively closing off the liquid passage conduit of the spray nozzle;

a device for rotating the liquid coating product inside the spray nozzle, as the liquid coating product circulates through the liquid passage conduit, this device:

being a separate part from the needle valve, being received inside the liquid passage conduit, being secured to the spray nozzle so as to be entirely immobile in the liquid passage conduit, defining a central through bore for the passage of the needle valve, and comprising a body, immobile in the liquid passage conduit, defining at least one helical slot for the passage of all or part of the liquid coating product, the spray gun being configured so that the liquid coating product circulates in said at least one helical slot, so that said at least one helical slot causes the liquid coating product to circulate in a helical direction around the spray axis of the spray gun; and a spray head defining two compressed air discharge orifices extending at least partially through the spray head and configured to guide air jets towards the spray axis so that said air jets strike a jet of liquid coating product discharged through the spray nozzle to form a spray;

wherein the spray nozzle is arranged coaxially with the spray head and at least partially inside the spray head.

2. The spray gun according to claim 1, wherein an enclosure surface of the body has a circular or elliptical section.

3. The spray gun according to claim 1, wherein an enclosure surface of the body is at least partially cylindrical and/or frustoconical.

4. The spray gun according to claim 1, wherein an enclosure surface of the body comprises a cylindrical upstream part and a frustoconical downstream part.

5. The spray gun according to claim 1, wherein the device further comprises a gripping handle, which has a smaller diameter relative to the body.

6. The spray gun according to claim 5, wherein a length of the gripping handle is greater than or equal to 5 mm.

7. The spray gun according to claim 1, wherein the device is manufactured by 3D printing.

8. The spray gun according to claim 1, wherein the body comprises a cylindrical upstream part and a frustoconical downstream part, and wherein each helical slot extends continuously through the cylindrical upstream part and through the frustoconical downstream part of the body.

9. The spray gun according to claim 1, wherein the spray gun is a manual or automatic spray gun.

10. The spray gun according to claim 1, wherein the liquid passage conduit defines a housing for receiving the device that has a shape complementary to that of an enclosure surface of the body of the device.

11. The spray gun according to claim 10, wherein:

the housing has a shape complementary to that of the body of the device;

the liquid passage conduit comprises, from upstream to downstream, a first cylindrical segment and a second frustoconical segment, the cross section of which decreases from upstream to downstream; and the device is disposed in the liquid passage conduit and is long enough to remain immobile in translation when liquid coating product is circulated from the cylindrical upstream part to the frustoconical downstream part.

12. The spray gun according to claim 1, wherein the liquid passage conduit comprises a flared and rounded discharge segment.

13. The spray gun according to claim 1, wherein the device is forcibly mounted inside the liquid passage conduit of the spray nozzle.

14. The spray gun according to claim 1, wherein the body comprises a cylindrical upstream part and a frustoconical downstream part, and wherein each helical slot extends continuously on a surface of the cylindrical upstream part and on a surface of the frustoconical downstream part.

15. The spray gun according to claim 14, wherein each helical slot is continuous from the surface of the cylindrical upstream part to a termination of the helical slot on the surface of the frustoconical downstream part.

16. The spray gun according to claim 1, wherein the spray gun further comprises a trigger and wherein the movement of the needle valve is controlled by the trigger.

* * * * *